United States Patent [19]

Han

[11] 3,990,756

[45] Nov. 9, 1976

[54] SELF-ALIGNING, SELF-ADJUSTING DISHWASHER RACK

[75] Inventor: Kyung S. Han, Louisville, Ky.

[73] Assignee: General Electric Company, Louisville, Ky.

[22] Filed: July 1, 1975

[21] Appl. No.: 592,121

[52] U.S. Cl. ..... 312/311; 312/334; 312/341 R; 211/151

[51] Int. Cl.[2] ..... A47B 88/00

[58] Field of Search ..... 312/311, 334, 341; 211/151, 162; 301/63 PW

[56] References Cited

UNITED STATES PATENTS

| | | | |
|---|---|---|---|
| 338,459 | 3/1886 | Adams | 211/151 |
| 2,462,397 | 2/1949 | Hendricks | 312/341 |
| 2,799,541 | 7/1957 | Wolters | 312/341 |
| 3,095,250 | 6/1963 | Frederick | 312/341 |
| 3,107,947 | 10/1963 | Hulterstrum | 301/63 PW |
| 3,194,610 | 7/1965 | Stewart | 312/341 |
| 3,214,227 | 10/1965 | Filipowicz | 312/341 |
| 3,347,612 | 10/1967 | Bebinger | 312/311 |
| 3,383,148 | 5/1968 | Dicken, Jr. | 211/151 |
| 3,679,282 | 7/1972 | Kauffman | 312/311 |

*Primary Examiner*—Paul R. Gilliam
*Assistant Examiner*—Victor N. Sakran
*Attorney, Agent, or Firm*—Francis H. Boos

[57] ABSTRACT

A dishwasher rack support system which includes truncated-shaped rollers mounted to flexible axles which allow the wheels to angle outwardly to compensate for the taper in a molded, tapered, plastic dishwasher tub.

3 Claims, 5 Drawing Figures

SELF-ALIGNING, SELF-ADJUSTING DISHWASHER RACK

BACKGROUND OF THE INVENTION

In domestic dishwashing machines of the front-opening type wherein the washing chamber is comprised of a molded plastic tapered tub, it has become necessary for manufacturers to provide means whereby the dishwasher rack moves freely in and out of the chamber without excessive lateral or sideways movement. It is also important, however, that the dishwasher rack be provided with means which prevent it from moving into the washing chamber on a skewed angle. Similarly, it is important that the support means compensate for the taper of the chamber, lest the rack fall into the bottom of the chamber as it is being moved.

Heretofore, the problem has not been of specific concern since wash chambers were generally fabricated of metal and tapered very little, if at all. Thus, there was no need to provide a rack support means which compensated for the taper. However, with the advent of plastic dishwasher tubs, having an increased taper to facilitate molding of the tubs, the problem of providing a support means which compensates for the taper and yet allows the rack to be easily inserted and removed from the chamber without skewing, has manifested itself.

One attempt at solving the problem of skewing in a chamber is shown in U.S. Pat. No. 3,095,250. However, since the cabinets of concern to the inventor were not tapered, he did not face the problem of providing a support means which would prevent the drawer from falling as the taper widened. Therefore, he, of course, did not suggest a solution to the problem.

Other U.S. patents showing support mechanisms for racks in dishwashers include U.S. Pat. No. 3,347,612; U.S. Pat. No. 3,466,105; and U.S. Pat. No. 3,851,943. However, none of these patents suggest a solution to the problems posed by a tapered plastic dishwasher tub.

SUMMARY OF THE INVENTION

The invention includes a dishwasher having a washing chamber comprised of a molded, tapered, plastic tub and a door for closing the tub. The chamber includes upper and lower dish-receiving racks mounted for movement in and out of the tub, with the lower rack mounted at a level above the bottom of the tub. The lower rack-mounting arrangement includes means which allows the rack to be easily removed and inserted without falling into the tub bottom and, in addition, prevents the rack from becoming skewed during such movement. The mounting means includes axle members, attached to the rack, and supporting wheels having a generally truncated cone configuration. The side wall of the cone provides the bearing surface which engages a track means integral with the chamber sidewall. The flexible axles enable the wheels to move to an inclined position, thereby widening as the rack is withdrawn from the tub and compensating for the tub's taper.

More specifically, the invention includes a dishwashing machine of the front-loading type having a wash chamber and an access opening thereto, said chamber having sidewalls and a door pivotally mounted adjacent its bottom edge for movement between a substantially vertical position wherein said chamber opening is closed and a substantially horizontal position wherein said chamber opening is open; a rack for supporting dishes to be washed, said rack being movably mounted in the chamber for movement between a loading position, wherein the rack extends at least partially out through the access opening of the chamber, and a retracted position wherein the rack is fully within the chamber, said rack being at least partially supported on said door when said door is in the horizontal open position; and support structure for said rack comprising a pair of parallel support means within said chamber disposed integral with said sidewalls in a position substantially coplanar with said door when said door is in said open position, said support means and said door providing support surfaces for said rack; front and rear wheel means secured to opposite sides of said rack at a variable pitch with respect to said sidewalls; each of said wheel means having a generally truncated cone configuration with the side of said cone configuration bearing against said support means; flexible axle means mounted to said rack and supporting said wheel means such that when the rack is withdrawn from said chamber the axle means flex to provide that the wheel means spread apart to maintain the stability of said rack. Advantageously, the axle means are preselectively sized to flex whereby, when said rack is repositioned in said chamber, said wheel means abut against said sidewalls, thereby becoming more upright and thereby maintaining a close fit in said chamber, said wheel means collectively functioning to compensate for the taper of said chamber.

DESCRIPTION OF THE PREFERRED EMBODIMENT

Figure 1:
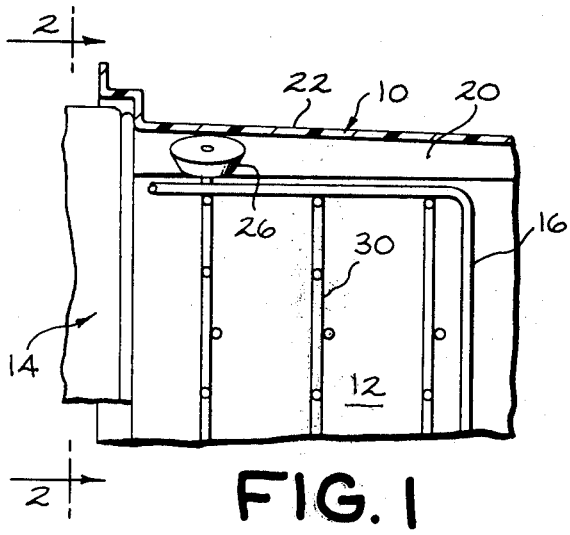
FIG. 1 is a partial cross-sectional plan view of a dishwasher rack in its loading position partially outside a tapered dishwasher tub.

FIG. 1 shows a tub 10 of an automatic dishwashing machine which defines an interior wash chamber 12. An access opening is provided on the front side of tub 10 and is normally covered by a hinged access door 14. Contained within the wash chamber 12 is rack 16 for supporting dishes and other utensils to be washed within the machine.

Rack 16 has support means 18 located on each of its respective sides for supporting it at a level above the tub bottom. Conventionally, support means 18 are designed to cooperate with oppositely-disposed support ledges 20 integral with wash chamber sidewalls 22 and 24. Support means 18, in cooperation with support ledges 20, enable the user of the dishwasher to manually pull the rack 16 outwardly from its wash position within the chamber 12 to a loading position at least partially outside the wash chamber. In such a loading position, the rack is in contact with and supported by the open door 14.

Support means 18 includes a series of rear wheels 26 and front wheels 27 mounted on flexible axles 28 which, in turn, are mounted at generally the four corners of the rack 16. In the alternative, if a wire rack is being used, its design may include integral therewith, projecting, flexible axles 28 as an extension of rack cross-members 30.

Figure 2:
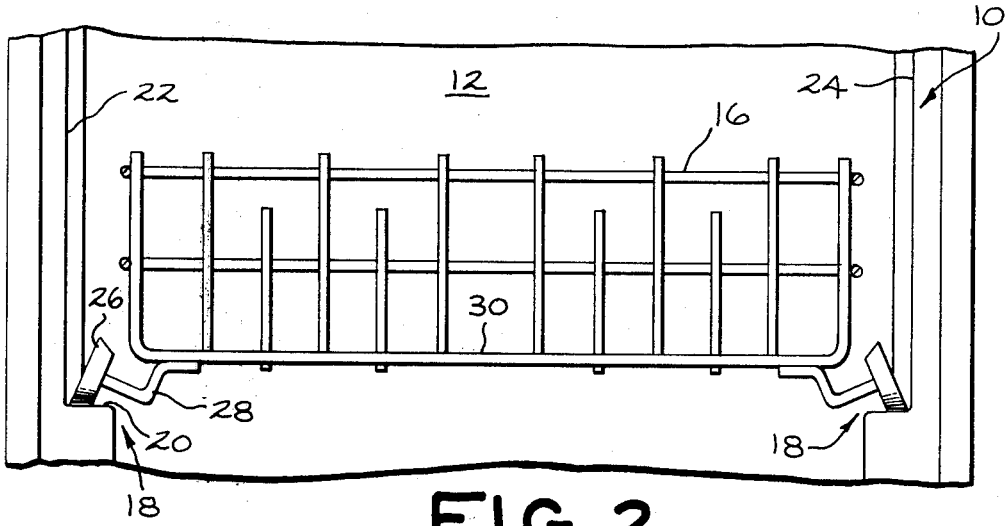
FIG. 2 is a view taken along lines 2—2 of FIG. 1, showing a front elevational view thereof.
Figure 4:
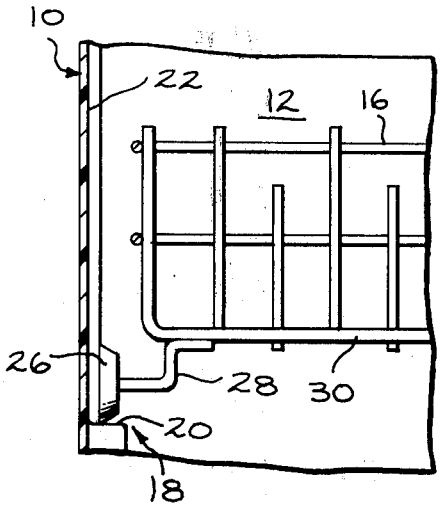
FIG. 4 is a view similar to FIG. 2 taken along the lines 4—4 of FIG. 3, showing the orientation of the rear rack wheels and axles.

Focusing now on FIGS. 2 and 4, it will be observed that wheels 26 are permitted to incline, depending upon their relative position inside the tapered tub 10. Specifically, it can be seen that rear wheels 26, when in their forwardmost position, are inclined at an angle with respect to the tub sidewalls.

Figure 3:
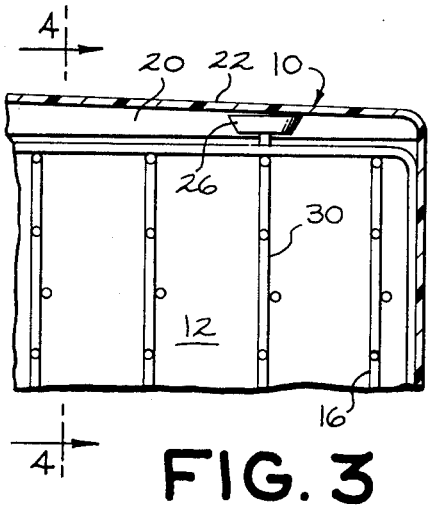
FIG. 3 is a partial cross-sectional plan view of a dishwasher rack in its wash position within a tapered dishwasher tub.

Thus, it can be seen that, when the rack is withdrawn from wash chamber 12 for loading and unloading, the flexible axles bend, allowing the rear wheels 26 to spread and continue to engage the sidewalls 22 and 24 of the tub. Thus, little lateral movement of the rack is allowed. Correspondingly, as the rack is again inserted into the tapered sidewalled tub, the action of the rear wheels 26 bearing against the sidewalls forces them into a more upright position, as shown in FIGS. 3 and 4; again, in large measure, eliminating any lateral movement. More importantly, however, rack 16 is prevented from dropping downwardly into the chamber therebelow which is conventionally occupied by a portion of the wash mechanism.

It should be noted that when the rack is fully loaded, the weight distribution thereon may tend to bow flexible axles 28 even more. However, such bowing is generally not a problem since the taper of the wheels is such that they would not engage the rack 16 under normal loading conditions. Nor would the axles 28 allow the rack to descend to a level which would interfere with the wash mechanism located therebelow.

Figure 5:
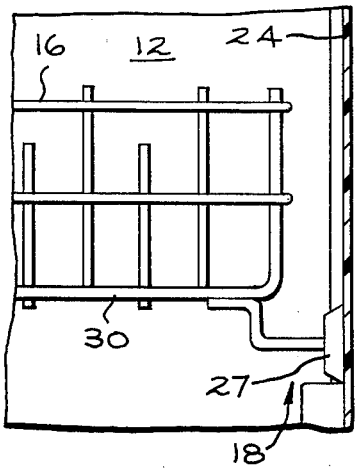
FIG. 5 is a partial cross-sectional elevational view of a dishwasher rack of this invention in its wash position within a tapered dishwasher tub.

Also, it should be noted that this same feature, of flexible axles and tapered wheels, can be utilized in the design of the front wheel support means of the dishwasher rack, as shown in FIG. 5. In that event, it will be appreciated that the beneficial effects will be noticed primarily when the rack is fully, or nearly fully, inside the tub. Moreover, it is possible to provide the inside surface of the door with retaining ridges (not shown) to take advantage of the stabilizing effect of the novel wheel mounting arrangement.

Having thus described the invention, what is claimed is:

1. A dishwashing machine of the front-loading type having a wash chamber and an access opening thereto, said chamber having sidewalls and a door pivotally mounted adjacent its bottom edge for movement between a substantially vertical position, wherein said chamber opening is closed and a substantially horizontal position wherein said chamber opening is open;

a rack for supporting dishes to be washed, said rack being movably mounted in the chamber for movement between a loading position, wherein the rack extends at least partially out through the access opening of the chamber, and a retracted position, wherein the rack is fully within the chamber, said rack being at least partially supported on said door when said door is in the horizontal open position;

support structure for said rack comprising a pair of parallel support means within said chamber disposed integral with said sidewalls in a position substantially coplanar with said door when said door is in said open position, said support means and said door providing support surfaces for said rack;

wheel means secured to opposite sides of said rack at a variable pitch with respect to said sidewalls, each of said wheel means having a generally truncated cone configuration with the side of said cone configuration bearing against said support means;

flexible axle means mounted to said rack and supporting said wheel means such that when the rack is withdrawn from said chamber, the axle means flex to provide that the wheel means spread apart to maintain the stability of said rack.

2. The dishwasher of claim 1 wherein said axle means are preselectively sized to flex, whereby, when said rack is repositioned in said chamber, said wheel means abut against said chamber sidewalls, thereby becoming more upright and maintaining a close fit in said chamber.

3. The dishwasher of claim 1 wherein said wheel means includes both front and rear rack wheels.

* * * * *